United States Patent [19]

Mouraret et al.

[11] Patent Number: 4,829,688

[45] Date of Patent: May 16, 1989

[54] PANEL FOR DISPLAYING LARGE SIZE ARTICLES

[75] Inventors: Guy Mouraret, Vals-Les-Bains; Jean Gleyze, Aubenas, both of France

[73] Assignee: Constructions Metalliques Ardechoises CMA, France

[21] Appl. No.: 111,999

[22] Filed: Oct. 21, 1987

[30] Foreign Application Priority Data

Oct. 23, 1986 [FR] France ..... 86 14928
Oct. 23, 1986 [FR] France ..... 86 14929

[51] Int. Cl.[4] ..... G09F 7/06
[52] U.S. Cl. ..... 40/622; 40/601
[58] Field of Search ..... 40/620, 622, 489, 601, 40/19.5, 624, 22; 248/216.4, 217.3; 211/54.1, 59.1

[56] References Cited

U.S. PATENT DOCUMENTS

| | | | |
|---|---|---|---|
| 1,748,220 | 2/1930 | Haney | 40/624 |
| 2,429,256 | 10/1947 | Block | 38/102.91 |
| 2,481,252 | 9/1949 | Skrumbellos | 254/336 |
| 2,591,494 | 4/1952 | Asachika | 40/601 |
| 3,533,179 | 10/1970 | Horton | 40/584 |
| 3,609,898 | 10/1971 | Brown | 40/601 |
| 3,673,720 | 7/1972 | Thornton | 40/601 |
| 3,799,357 | 3/1974 | Govang | 211/59.1 |
| 3,858,727 | 1/1975 | Levko | 211/89 |
| 3,958,349 | 5/1976 | Nidekoff | 40/607 |
| 4,179,831 | 12/1979 | Cook | 40/19.5 |
| 4,471,548 | 9/1984 | Goudie | 40/610 |

FOREIGN PATENT DOCUMENTS

| | | | |
|---|---|---|---|
| 994279 | 11/1951 | France . | |
| 1318329 | 1/1963 | France | 40/622 |
| 1517277 | 7/1978 | United Kingdom . | |
| 2131215 | 6/1984 | United Kingdom . | |

*Primary Examiner*—Robert P. Swiatek
*Assistant Examiner*—Cary E. Stone
*Attorney, Agent, or Firm*—Wall and Roehrig

[57] ABSTRACT

A panel making it possible to display bills or similar articles of large size, comprising a plate of small thickness which is preferably made of metal (but which could, if appropriate, be based on another material, such as plastic), this plate having dimensions corresponding at least to the dimensions of the bill to be displayed. The panel has distributed uniformly over the periphery of its front face a series of blades capable of perforating the bill when it is placed against the surface, and orifices intended for retaining fasteners inwardly disposed from pressing elements which are laid against the bill after it has been put in place on the blades which cover at least the periphery of the bill.

6 Claims, 4 Drawing Sheets

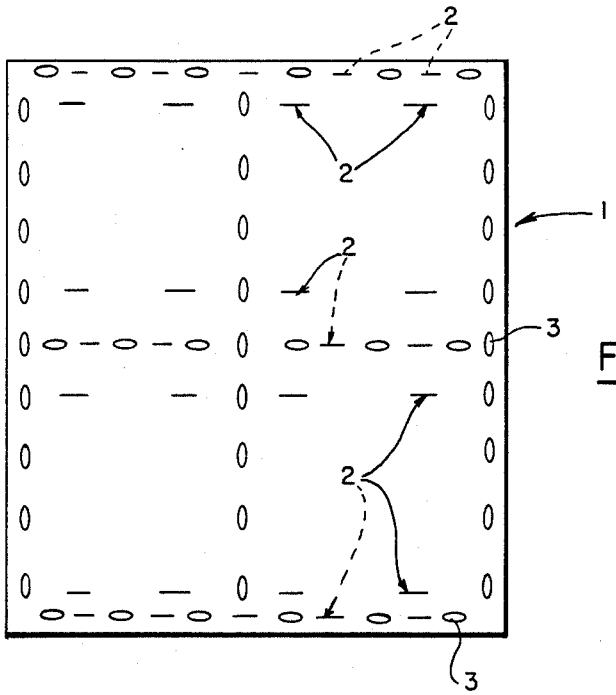
FIG. 1.
FIG. 2a
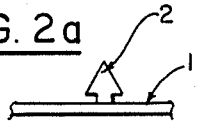
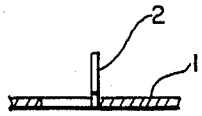
FIG. 2b.
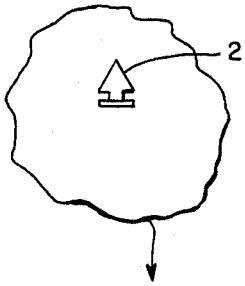
FIG. 3a.
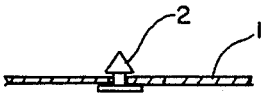
FIG. 3b.

PANEL FOR DISPLAYING LARGE SIZE ARTICLES

BACKGROUND OF THE INVENTION

The present invention relates to an improvement made to panels making it possible to display advertising bills or similar articles. Of course, the panel according to the invention is not limited to such a use.

Hitherto, for displaying bills, the said bills have usually been glued to the surface of the panels used. The operation of attaching and removing the said bills is lengthy and difficult to carry out and requires not only the preparation of a glue, but also the cleaning of the surface, the use of special tools, etc.

In sectors other than bill-posting which requires the positioning of a sheet against a vertical panel, it has been proposed to ensure that the said sheet is retained by means of grippers or by means of magnets when the support is metallic. However, such solutions are not possible for displaying large size bills which may be several meters long and high (generally 3 m×4 m).

To solve this problem presented by gluing, U.S. Pat. No. 1,748,220 a long time ago proposed using panels having movable bars supporting elements in the form of needles intended for ensuring the retention of adhesive strips, against which the bill to be displayed is itself laid. Although such a solution makes it possible to solve the problem of coating the panel with glue, it nevertheless requires highly complex means in order to put it into practice. Moreover, the bills (or the like) can easily be torn off from the supporting surface.

For displaying small-size elements, such as, for example, announcements or sundry memoranda, U.S. Pat. No. 3,858,727 proposed using perforated panels. The sheet to be displayed is laid against the panel and retention is ensured by means of a pressing element which comprises, on the one hand, branches or studs capable of fitting into the perforations and, on the other hand, a needle which perforates the sheet. Such a solution can be considered an improvement on conventional thumbtacks which avoids damaging the display surface. Such a "tacking" system, although suitable for small-size sheets, is nevertheless inappropriate for attaching large-size bills.

SUMMARY OF THE INVENTION

Now a new type of panel of simple design has been found. This panel is the subject of the present invention, and overcomes the disadvantages of previous solutions by making it possible to attach and remove easily the bills which it supports. The panel also ensures perfect retention of said bills, and virtually eliminates the risks of tearing and damage as a result of inclement weather (rain, wind).

In general terms, the panel according to the invention comprises a thin plate which is preferably made of metal, but which if appropriate, could be formed of another material, such as plastic. The plate has dimensions corresponding at least to the dimensions of the bill to be displayed, and is defined in that it possesses, distributed uniformly at least over the front face of the said panel, blade like elements capable of perforating the bill when it is placed against the surface and at least one pressing element which is laid against the bill after it is placed against the face of the plate.

In a preferred embodiment according to the invention, the blades intended for perforating the bill when it is put in place take the form of cutting blades of triangular cross-section, either obtained as a result of the deformation of the metal plate forming said panel or attached to a surface, for example by welding. Moreover, the pressing elements making it possible to ensure the final retention of a bill after it has been put in place take the form of continuous transparent strips having, spaced at regular intervals on their lower face, fasteners, the dimensions and structure of which are such that they can not only perforate the bill, but also fit into the orifices located in the panel. In general, the orifices and blades are distributed uniformly over the surface of the panel, in such a way that it is possible to use the same panel for bills of different sizes and/or ensure the retention of one and the same bill produced from several elements. These orifices and blades will preferably be arranged alternately next to one another, for example at the rate of one or two orifices to one tab.

Although the new type of panel according to the invention can be used fixed in place, for example, by mounting it against a wall, it is designed particularly to make it possible to provide a new type of movable bill-posting panel which is also the subject of the present invention. In such a use, the panel takes the form of a box closed on its rear face. The front face of the panel is equipped, according to the invention, with orifices and blades. The box is mounted on a fixed support which is vertically disposed and along which it can slide. The assembly possesses a mechanism for making it possible to lock the panel in a high position after the bill has been secured in place and a counterweight system which is connected to the panel, and which balances it during the handling of the latter. The counterweights are slidably mounted within the support itself.

In such a movable assembly, the support can comprise two parallel hollow columns, the box-shaped panel being arranged between these columns and having means forming slides on its lateral edges, each column serving as a guide element for a counterweight connected to the upper edge of the panel by means of a cable. In the upper part of each column there is a grooved pulley ensuring that the connecting cables are guided between the panel and the counterweights. According to an alternative version making it possible to provide a two-faced display assembly, two box-shaped panels of the abovementioned type are mounted on either side of plates firming spaces with the plates being capable of sliding along the two columns. The two panels are likewise balanced by means of a counterweight system movable within the said columns.

BRIEF DESCRIPTION OF THE DRAWING

The invention and its advantages will be better understood from the exemplary embodiments which are given below as a non-limiting indication and which are illustrated by the accompanying drawing, wherein:

FIG. 1 is a diagrammatic plan view of a panel according to the invention,

FIGS. 2*a*–2*b* and 3*a*–3*b* show two embodiments of the blades mounted on the face on such a panel.

DETAILED DESCRIPTION OF THE PREFERRED EMBODIMENT

Figure 6:
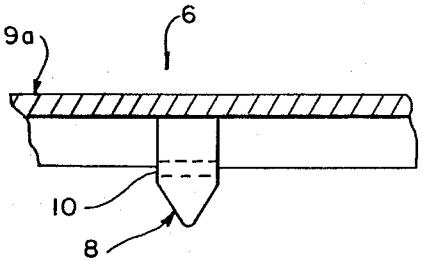
FIG. 6 is a section along the line BB of FIG. 5.

Referring to the accompanying FIG. 1, the panel according to the invention takes the form of a plane plate which is preferably made of metal and the outer dimensions of which are governed by the bills to be displayed. This plate 1 has, on the one hand, blades 2 in the form of tabs, which are distributed uniformly over its front face and at least on its periphery and which have a structure of the type illustrated in FIGS. *2a–2bl and 3a–3b.* Such blade 2 can either be obtained as a result of the deformation of the metal plate 1 as illustrated in FIGS. *2a* and *2b* or comprise attached elements fastened in the plate by welding (see FIGS. *3a–3b*) . In both cases, the blades take the form of thin triangular members. These blades are intended for perforating the bill when it is placed against the front face of the panel 1 and serve to ensure its temporary retention.

Furthermore, according to the invention, orifices 3 which are oblong, square, etc. are likewise distributed uniformly at least over the periphery of the said panel. As will be seen later in the description, these orifices 3 are intended for receiving the end of elements serving for ensuring the final retention of the bill against the face of the panel 1. The distribution and number of perforations 3 and of blades 2 provided on the front face of the panel 1 can be variable. In general, the surface has uniformly distributed perforations, for example square perforations having side dimensions of 7 m×7 m distributed at a distance between centers of 35.7 m. Of course, any other dimension could be considered. Moreover, the blades 2 will be either slightly offset relative to the perforations 3 (embodiment illustrated in FIG. 2) or preferably arranged alternating with the perforations in a sequence, for example one perforation 2 to one blade (the embodiment in FIG. 1, in which the referring arrows are represented by broken lines).

Figure 5:
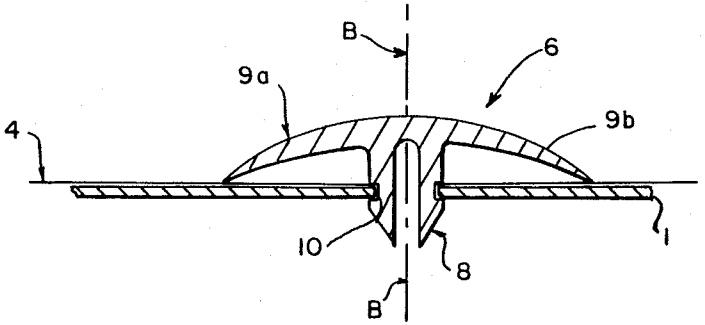
FIG. 5 is an enlarged detailed sectional view taken along the line AA of FIG. 4, illustrating the structure of such a retaining strip.
Figure 4:
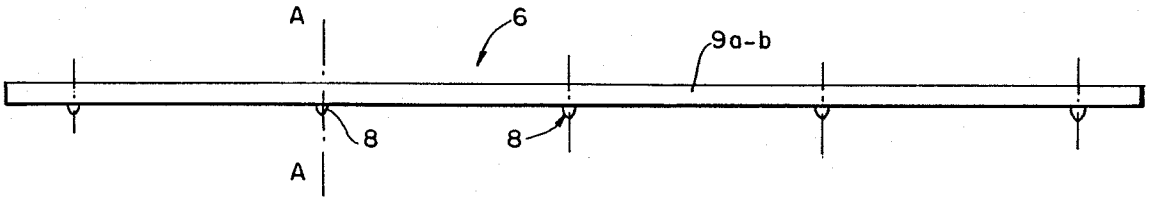
FIG. 4 is a side elevation of a strip for retaining a bill after it has been placed on the blades.

According to the preferred embodiment illustrated in FIGS. 4 to 6, the elements making it possible to ensure the final retention of the bill 4 against the surface 11 of the panel take the form of a strip 6 of long length (generally several tens of centimeters), in the lower part of which are distributed uniformly fasteners 8 intended to fit into the orifices 3 in the panel. These strips have a cross-section of the type illustrated in FIGS. 5 and 6, that is to say they comprise an upper face of the elements in relief 8. After the elements 6 have been put in place, such edges *9a,9b* make it possible to ensure continuous protection over the entire periphery of the bill, in particular preventing any infiltration of water between the supporting panel and this bill. The fasteners 8 themselves have such a structure that they can perforate the bill and, simply as a result of pressure, fit into the orifices 3 and lock in these orifices. For this purpose, these fasteners 8 not only are pointed so that they can pierce the bill when they are put in place, but also have a certain elasticity, allowing them to be introduced more easily into the orifices 3. To ensure that the fasteners 8 are locked after being fitted, they have locking tabs 10 which, after the bill as been perforated and the elements have been introduced into the he orifices 3, fit under the edges of the said orifices 3.

Such a panel is used in the following way:

First of all, the user lays the bill against the surface of the panel, the blades 2 perforating this bill. Once this has been done, the user can therefore take his time and have his hands free to secure the strips 6 to the periphery of the bill which is thus immobilized perfectly on the surface of the panel. In order to remove the bill, it is sufficient to exert a pull on the retaining strips in order to release them from the peripheral orifices 3. Should the bill be composed of several parts intended to be joined to one another, or if it is desired to improve the hold where a large-area bill is concerned, it is of course possible to attach retaining elements 6 not only on the periphery, but also along the median lines of the panel, in which case the orifices distributed over the length and the width are used.

Such a type of panel, of especially simple design, has many advantages in that it eliminates the need to employ glue and does not require any type of special tool for its use. Moreover, since the panel is always perfectly clean, it is possible to decorate it so that, in the absence of a bill, it serves as a permanent advertising element.

Figure 7:
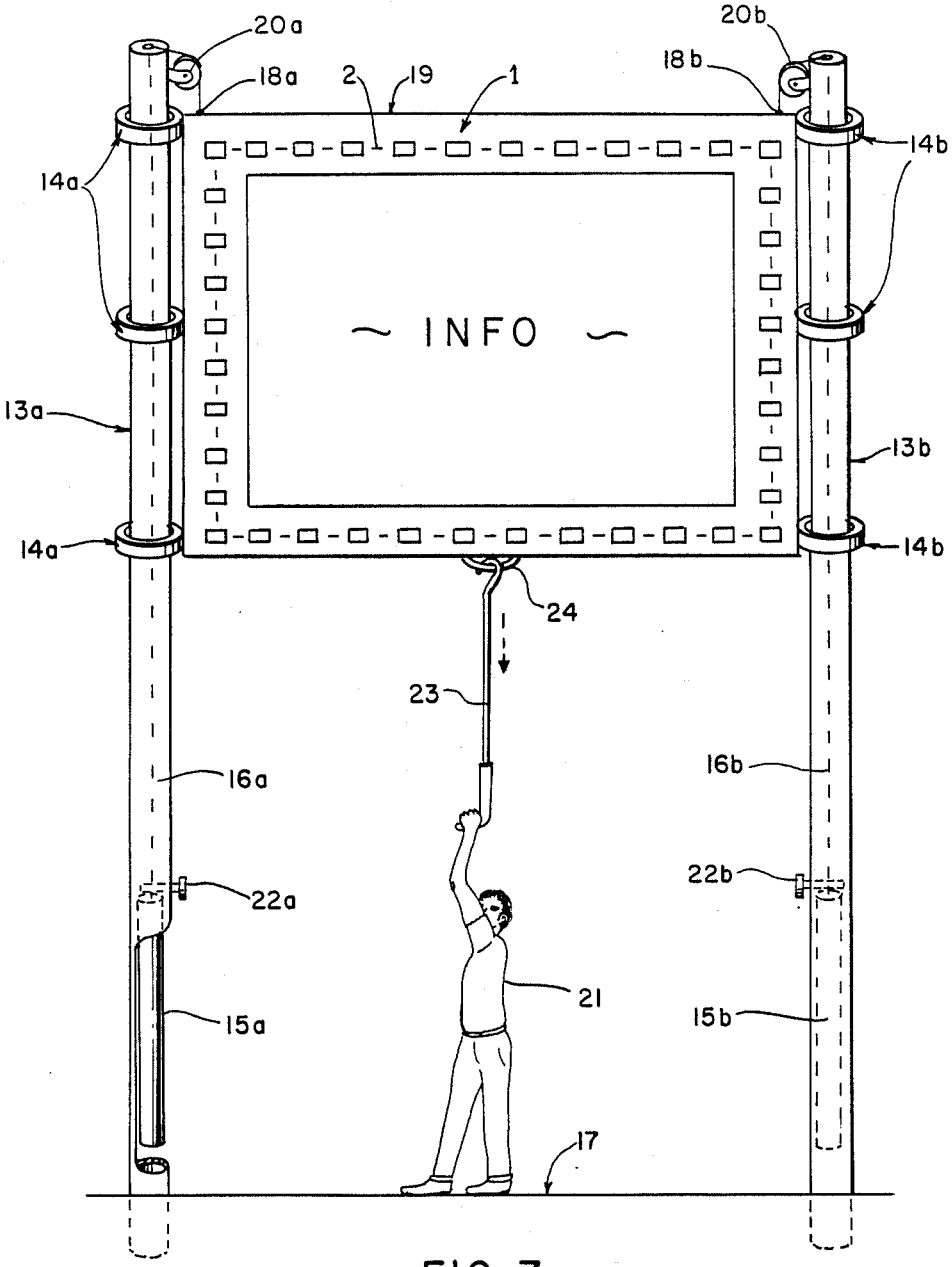
FIG. 7 shows diagrammatically a front view of a panel according to the invention that is mounted for movement along retaining supports.
Figure 8:
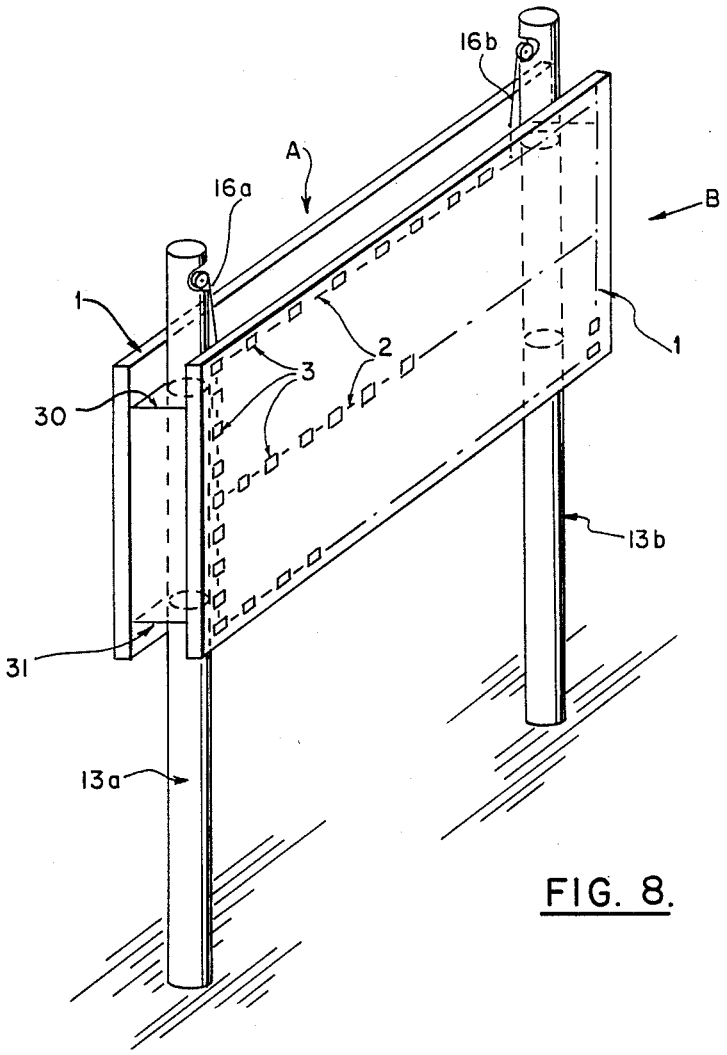
FIG. 8 is a diagrammatic view of another embodiment according to the invention.

Such a pane can be used permanent in a conventional way by mounting it fixed in place against a facade or any equivalent support. However, it is designed particularly for producing a new type of bill-posting assembly, in which the actual panel, to the surface of which the bill is affixed, is mounted so as to be movable on a fixed vertical support. FIGS. 7 and 8 illustrate two types of such an assembly, the bill 4 and the retaining stripes 6 not being shown for the sake of simplicity.

Referring to FIG. 7, the panel 1 according to the invention, to the surface of which the bill 2 is affixed, is mounted on a fixed vertical support comprising two identical columns 13*a*, 13*b* intended to be secured to the ground 17 permanently or not. The panel 1, although this does not emerge from FIG. 7 takes the form of a box, only the front face of which can be seen in FIG. 7 and which has perforations and tabs, as described above. The rear face and the sides are themselves closed, to prevent air from blowing in at the rear of the panel. The panel 1 is arranged between the columns 13*a* and 13*b* by means of elements forming slides along these columns, for example by means of three collar 14*a*, 14*b* which surround the said columns 13*a*, 13*b* at least partially and which are fastened to the lateral faces of the box of the panel 1. The collars 14*a*, 14*b* have a cross-section, the form of which corresponds to the outer cross-section of the columns, for example circular. Other types of column cross-section, for example a polygonal cross-section, would be possible. The two columns 13*a*, 13*b* are hollow, so as to serve as guide elements for a counterweight system which, in this case, comprises two cylindrical counterweights 15*a*, 15*b* each suspended on cables 16*a*, 16*b*, the other end 18*a*, 18*b* of which is connected to the upper edge 19 of the panel 1. Moreover, in order to ensure that the connecting cables 66*a*, 16*b* are deflected in the upper part of each of the columns 13*a*, 13*b*, grooved pulleys 20*a*, 20*b* are mounted at the end of the said columns and serve as guide elements for the cables 16*a*, 16*b*. Finally, on the columns there are means which make it possible to immobilize the panel in the high position and which can be formed by retractable stops actuable by the operator at 21. These stops can be composed, for example, of two elements 22*a*, 22*b* insertable into the columns 13*a*, 13*b* above the two counterweights 15*a*, 15*b*. The two counterweights 15*a*, 15*b* are determined in such a way that they balance the panel 1 perfectly.

FIG. 8 illustrates, in perspective, another embodiment of a display assembly comprising two panels according to the invention which can likewise be moved along columns 16*a*,16*b*. The two panels A,B are identical and have a front face 1 according to the invention, possessing orifices 3 and tabs 2 intended for ensuring the retention of the bill in interaction with the final fastening assemblies in the form of strips, as described above and illustrated in FIGS. 4 to 6.

These two panels A,B likewise take the form of boxes closed on their rear face and are connected to one another by means of plates forming spacers 30,31. The side plates themselves are not shown in FIG. 8. As before, the panels A,B are balanced by means of a counterweight system so that they are capable of sliding along the columns 13*a*, 13*b* through the plates 30,31. The counterweights are arranged within the columns 13*a* and 13*b* and, as mentioned above, are connected to the upper part of the panel by means of cables 18*a*, 18*b* which pass round guide pulleys fastened to the upper part of each column.

Such assemblies are used in the following way. When the operator 21 wishes to change the information (bill) carried on the panel, this bill having been put in place and retained in the way seen above (described with reference to FIGS. 1 to 4), it is sufficient, for example by means of a pole 23, to catch the end of the panel 1 which has a ring 24 and, if appropriate after removing the locking elements 22*a*, 22*b*, simply by exerting a pull, to lower the said panel which slides along the columns 13*a*, 13*b*. When the panel 1 is level with the ground, it is then easy to remove the initial bill 2 and replace it with another bill. When this has been done, the panel is returned to its high position and the locking elements 22*a*, 22*b* are refitted.

Of course, such assemblies comprising a movable panel produced according to the invention could be modified, without departing from the scope of the latter.

What is claimed is:

1. A panel for displaying a bill that includes a plate having at least one flat face for supporting a bill thereon which has peripheral dimensions at least equal to that of the bill to be displayed, said panel further including blade means extending outwardly from said at least one flat face of the plate for perforating a bill that is placed against said at least one flat face and a series of holes passing inwardly through said at least one flat face of the panel for receiving therein pressing elements that are seated against said at least one flat face of the plate over the bill which covers at least the periphery of the bill said pressing elements being continuous transparent strips having inwardly disposed fasteners that are lockingly received within said holes contained in a face of the plate.

2. The panel of claim 1 wherein the blade means are a series of triangular shaped blade members that depend from the face at spaced intervals about said plate.

3. The panel of claim 1 wherein the fasteners are thin pointed elements that can pierce a bill and which further includes locking tabs that are adapted to lock the bill against the face of the plate.

4. The panel of claim 1 wherein said panel is slidably mounted on a vertically disposed support means that includes two spaced apart hollow columns for slidably supporting the panel therebetween upon collar means that at least partially enclose the outer surface of said columns.

5. The panel of claim 4 wherein said support means a further includes a locking means for locking the panel in a desired elevated position upon said columns and a counterweight means for balancing the panel on said support means, said counterweight means being connected to the panel by cable means that passes over pulley means fastened in said support means.

6. The panel of claim 1 wherein said panel includes two spaced apart plates having opposed faces whereby bills can be mounted on both sides of the panel.

* * * * *